United States Patent [19]

Bobbe

[11] 4,066,353

[45] Jan. 3, 1978

[54] HALF TONE IMAGING SYSTEM

[75] Inventor: Richard M. Bobbe, Rochester, N.Y.

[73] Assignee: Xerox Corporation, Stamford, Conn.

[21] Appl. No.: 722,449

[22] Filed: Sept. 13, 1976

[51] Int. Cl.[2] ..... G03G 15/01

[52] U.S. Cl. ..... 355/4; 96/45; 355/32

[58] Field of Search ..... 355/4, 3 R, 32, 53, 355/8, 11, 67, 71; 96/45, 116–118

[56] References Cited

U.S. PATENT DOCUMENTS

| | | | |
|---|---|---|---|
| 3,905,822 | 9/1975 | Marks | 96/45 X |
| 4,003,649 | 1/1977 | Goren et al. | 355/4 |
| 4,007,981 | 2/1977 | Goren | 355/4 |

*Primary Examiner*—Richard L. Moses

*Attorney, Agent, or Firm*—J. J. Ralabate; C. A. Green; H. Fleischer

[57] ABSTRACT

A half-tone screen in which a first and second set of grooves are inscribed in a transparent member. The grooves are arranged in a repetitive pattern with each groove from the first set being interposed between adjacent grooves of the second set, and the width of each groove of the first set being greater than the width of each groove of the second set.

23 Claims, 3 Drawing Figures

HALF TONE IMAGING SYSTEM

BACKGROUND OF THE INVENTION

This invention relates generally to an electrophotographic printing machine, and more particularly concerns a half-tone screen for modulating a light image of an original document being reproduced by the printing machine.

In the process of electrophotographic printing, a photoconductive member is charged to a substantially uniform level. The light image of the original document irradiates the charged portion of the photoconductive member dissipating selectively the charge thereon. This records an electrostatic latent image on the photoconductive member corresponding to the original document being reproduced. Generally, heat settable particles are employed to develop the latent image. These particles are transferred from the latent image to a sheet of support material, in image configuration. Heat is then applied to the particles permanently affixing them to the sheet of support material.

Multi-color electrophotographic printing is substantially the same as the process heretofore discussed. However, a plurality of cycles are employed, each cycle being arranged to reproduce a different color contained in the original document. This requires filtering the light image of the original document to record an electrostatic latent image corresponding to a single color thereof. Each of these latent images is developed with appropriately colored toner particles. The particles are then transferred to the sheet of support material, in superimposed registration with one another. This forms a multi-layered toner powder image on the sheet of support material. The multi-layered powder image is permanently affixed to the sheet of support material by the application of heat producing a permanent colored copy of the original document.

Heretofore, it has been difficult to produce copies having subtle variations of tone and color. In order to overcome this problem, a half-tone screen is frequently interposed into the optical system. This screen produces a screen pattern which modulates the electrostatic latent image recorded on the photoconductive surface to form tone gradations. These tone gradations are achieved by producing half-tone dots or lines of varying size. In the highlight zones, the dots or lines are small increasing in size throughout the intermediate shades until they merge together in the shadow regions. At the highlight end of the tonal scale, there will be complete whiteness, while, at the shadow end, there will be nearly solid blackness. Various patents describe the concept of screening. Exemplary of these patents are U.S. Pat. Nos. 2,598,732; 3,535,036; 3,121,010; 3,193,381; 3,776,633; and 3,809,555.

There are two general approaches for creating half-tone images. One of these techniques is termed multiplicative. A multiplicative system employs a screen interposed into the optical light path. Thus, a light image of the original document passes through the screen as it irradiates the charged portion of the photoconductive surface. The screen modulates or finely divides the light image to form a half-tone image. In this manner, a modulated electrostatic latent image is recorded on the photoconductive surface. Alternatively, the light image of the original document may remain unmodulated, as is the case for sequential screening. In this approach, a half-tone screen is illuminated independently prior to, or subsequent to, irradiation of the charged portion of the photoconductive member with the light image of the original document. Both the screen pattern and electrostatic latent image are recorded independently and in superimposed registration with one another to produce a modulated electrostatic latent image on the photoconductive surface. U.S. Pat. No. 3,540,806 issued to Starkweather in 1970 is an example of a teaching of sequential screening. As disclosed therein, a light image of the original document is projected onto the charged portion of the photoconductive member, and subsequently or prior thereto, a light image of the screen pattern is projected thereon. In this manner, the electrostatic latent image is modulated.

Different types of screens may be employed in either multiplicative or sequential screening. For example, U.S. Pat. No. 521,659 issued to Levy in 1894 discloses a screen having a grid or parallel, mutually othogonal opaque lines. Each axis contains one set of thick parallel lines and one set of thin parallel lines. The spacing between adjacent thick and thin lines appears to vary. Similarly, U.S. Pat. No. 725,252 issued to Jacobson in 1903 discloses a half-tone screen comprising a grid of parallel lines. Each axis of the grid contains one set of thick parallel lines and a set of thin parallel lines. The spacing between adjacent thick and thin lines appears to be substantially the same. U.S. Pat. No. 1,919,481 issued to Rowell in 1933 describes a screen having a plurality of closely spaced parallel lines arranged to form a thick opaque region and a plurality of lines spaced further apart to form thin opaque regions. U.S. Pat. No. 3,627,526 issued to Donald in 1971 discloses a half-tone screen having a plurality of thick lines with a plurality of thin lines being mutually othogonal thereto. Finally, U.S. Pat. No. 2,719,790 issued to Monroy in 1955 discloses a half-tone screen having a plurality of sets of lines having different spaces therebetween and being repeated at a constant frequency. This forms a plurality of rectangles having a high density line pattern and a low density line pattern. However, in all of the foregoing screens there does not appear to be any optimization to achieve high quality copies in electrophotographic printing.

Accordingly, it is a primary object of the present invention to improve the screen employed in an electrophotographic printing machine to achieve high quality copies.

SUMMARY OF THE INVENTION

Briefly stated, and in accordance with the present invention, there is provided a half-tone screen including a substantially transparent member having a plurality of grooves formed therein.

Pursuant to the features of the present invention, the plurality of grooves comprise a first set of grooves and a second set of grooves with the width of each groove of the first set being greater than the width of each groove of the second set. The grooves are arranged in a repetitive pattern with each groove of the first set being interposed between adjacent grooves of the second set.

BRIEF DESCRIPTION OF THE DRAWINGS

Other objects and advantages of the present invention will become apparent upon reading the following detailed description and upon reference to the drawings, in which.

While the present invention will hereinafter be described in connection with preferred embodiments thereof, it will be understood that it is not intended to limit the invention to these embodiments. On the contrary, it is intended to cover all alternatives, modifications and equivalents as may be included within the spirit and scope of the invention as defined by the appended claims.

DETAILED DESCRIPTION OF THE INVENTION

Figure 1:
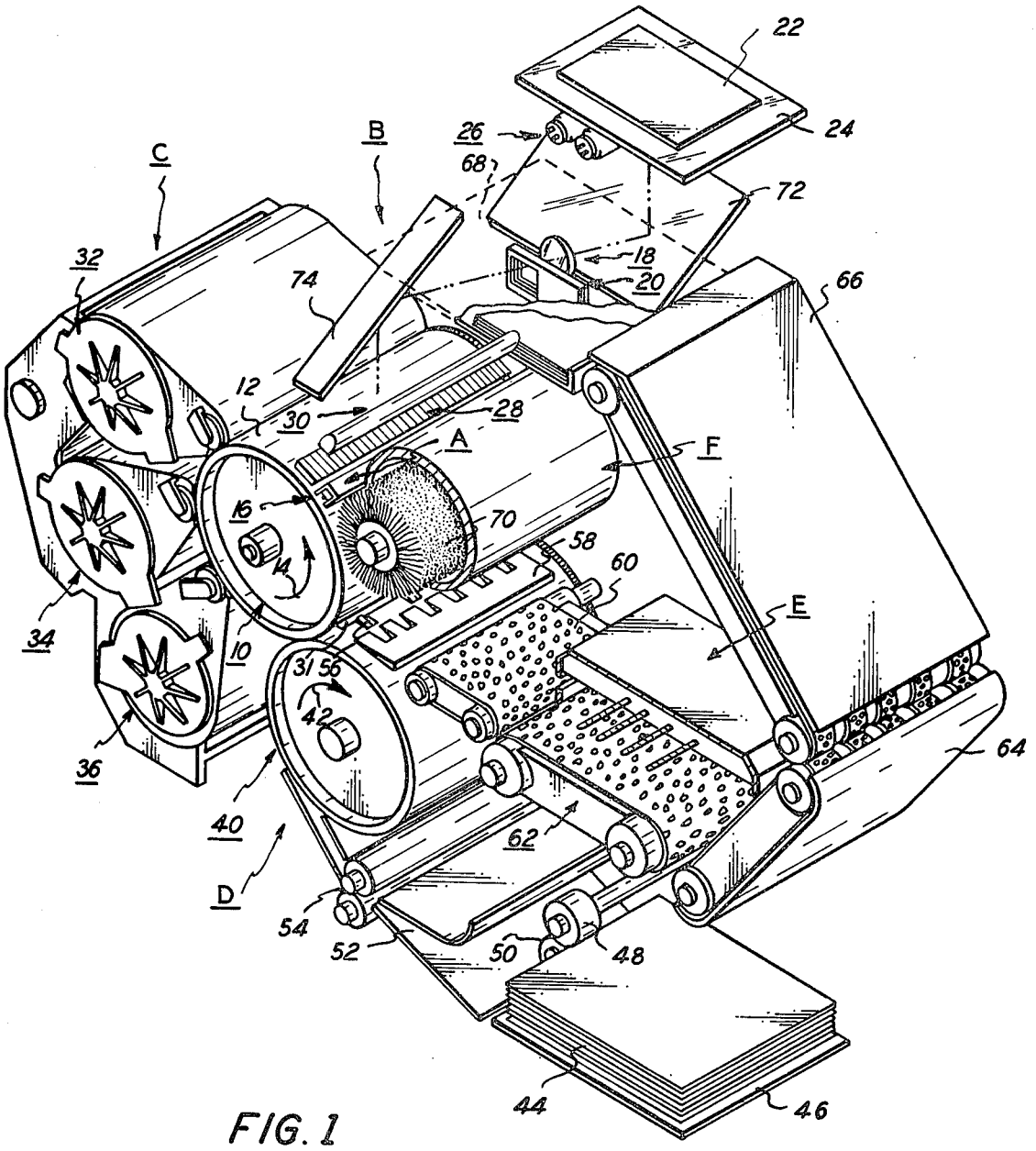
FIG. 1 is a schematic perspective view of an electrophotographic printing machine incorporating the features of the present invention therein.

A general understanding of an electrophotographic printing machine incorporating the features of the present invention therein may be had by referring to FIG. 1. In all of the drawings, like reference numerals have been used throughout to designate identical elements. As shown in FIG. 1, the electrophotographic printing machine is arranged to produce pictorial copies from a colored original document. The colored original document may be in the form of single sheets, books, three-dimensional objects, color slides, etc.

As depicted in FIG. 1, the electrophotographic printing machine comprises a photoconductive member having a rotatable drum 10 with a photoconductive surface 12 entrained thereabout and secured thereto. Drum 10 is mounted on a shaft (not shown) and rotated in the direction of arrow 14. In this manner, a portion of photoconductive surface 12 is moved sequentially through a series of processing stations. Photoconductive surface 12 is made preferably from a suitable selenium alloy such as is described in U.S. Pat. No. 3,655,377 issued to Sechak in 1972. An opaque disc (not shown) is mounted on one end of the shaft of drum 10. This disc cooperates with a light source and photosensor to produce an electrical signal. The electrical signal is processed by the machine logic to regulate activation of the appropriate processing station during the machine cycle.

For purposes of the present disclosure, the various processing stations in the printing machine will be briefly described hereinafter.

As drum 10 rotates, in the direction of arrow 14, it passes through charging station A. Charging station A includes a corona generating device, indicated generally by the reference numeral 16. Corona generating device 16 charges photoconductive surface 12 to a relatively high substantially uniform level. Preferably, corona generating device 16 extends generally parallel to the longitudinal axis of drum 10 across photoconductive surface 12. Corona generating device 16 produces a spray of ions charging at least a portion of photoconductive surface 12. One type of suitable corona generating device is described in U.S. Pat. No. 3,942,006 issued to Hayne in 1976.

Thereafter, as drum 10 rotates in the direction of arrow 14, the charged portion of photoconductive surface 12 passes through exposure station B. At exposure station B, a color filtered light image of the original document is projected onto the charged portion of photoconductive surface 12. A moving lens system, generally designated by the reference numeral 18, and a color filter mechanism, generally shown at 20, are positioned at exposure station B. U.S. Pat. No. 3,062,108 issued to Mayo in 1952 describes a moving lens system suitable for use in electrophotographic printing. Similarly, a suitable color filter mechanism for use in electrophotographic printing is described in U.S. Pat. No. 3,775,006 issued to Hartman et al., in 1973. Original document 22 is disposed face down upon transparent viewing platen 34. Lamp assembly 26, lens system 18 and filter mechanism 20 move in a timed relationship with drum 10 to scan successive incremental areas of original document 22. A suitable type of lens is described in U.S. Pat. No. 3,592,531 issued to McCrobie in 1971. A system of this type produces a flowing light image of original document 22. This light image corresponds to a single color of the informational areas contained within original document 22. Screen member 28 is positioned prior to, or, alternatively, subsequent to the optical light path. Actuation of lamp 30 illuminates screen 28 to record a finely divided uniformly distributed charge pattern on photoconductive surface 12, hereinafter referred to as a screen pattern. Thereafter, the light image of the original document is superimposed over the screen pattern to record a modulated electrostatic latent image on photoconductive surface 12. The details of the optical system will be described hereinafter with reference to FIG. 2 and the structure of screen 28 will be discussed, in greater detail, with reference to FIG. 3.

After recording the modulated electrostatic latent image on photoconductive surface 12, the latent image rotates through to development station C. At development station C, three individual developer units, generally designated by the reference numerals 32, 34 and 36 develop successive electrostatic latent images recorded on photoconductive surface 12. A suitable development station employing a plurality of developer units (in this case three) is described in U.S. Pat. No. 3,854,449 issued to Davidson in 1974. The developer units described therein are all of a type generally referred to in the art as magnetic brush developer units. Typically, a magnetic brush developer unit employs a magnetizable developer mix comprising ferromagnetic carrier granules and thermosettable toner particles triboelectrically attracted thereto. The developer unit forms a directional flux field to continually create a brush of developer mix. This developer mix brush is brought into contact with the modulated electrostatic latent image recorded on photoconductive surface 12. The toner particles adhering to the carrier granules of the developer mix are attracted therefrom to the latent image rendering it visible. Developer units 32, 34 and 36, respectively, contain differently colored toner particles. The toner particles contained with each of the developer units corresponds to the complement of the single color light image transmitted through each of the colored filters. For example, a single color electrostatic latent image formed from a green filtered light image is developed with green absorbing magenta toner particles. Similarly, electrostatic latent images formed from blue and red light images are developed with yellow and cyan toner particles, respectively.

After developing the electrostatic latent image recorded on the photoconductive surface 12 with toner particles, drum 10 rotates the toner powder image through station D. At transfer station D, the toner powder image adhering to photoconductive surface 12 is transferred to a sheet of support material 38. An electrically biased transfer roll, shown generally at 40, recirculates support material 38. Transfer roll 40 is electrically biased to a potential of sufficient magnitude and polarity to electrostatically attract toner particles from photoconductive surface 12 to the sheet of support material secured releasably thereon. In this way, transfer roll 40, which rotates in the direction of arrow 42, at substantially the same tangential velocity as drum 10, attracts successive differently colored toner powder images to sheet 38, in superimposed registration with one another. A suitable electrically biased transfer roll is described in U.S. Pat. No. 3,612,677 issued to Langdon et al. in 1971.

Turning now briefly to a description of the sheet feeding path, support material 38 is advanced from stack 44 disposed upon tray 46. Feed roll 48, in operative communication with retard roll 50, separates and advances the uppermost sheet from stack 44. The advancing sheet moves into chute 52 which directs it into the nip between register rolls 54. Register rolls 54 align and forward the advancing sheet, in synchronism with the movement of transfer roll 40. Transfer roll 40 has gripper fingers 56 mounted thereon. Gripper fingers 56 receive the advancing sheet and secure it releasably on transfer roll 40. After the requisite number of toner powder images have been transferred to sheet 38, in super-imposed registration with one another, gripper fingers 56 space sheet 38 from transfer roll 40. As transfer roll 40 continues to rotate in the direction of arrow 42, stripper bar 58 is interposed therebetween separating sheet 38 from transfer roll 40. Sheet 38 passes over stripper bar 58 onto conveyor 60. Endless belt conveyor 60 moves support material 38 to fixing station E.

At fixing station E, a fuser, indicated generally by the reference numeral 62, permanently affixes the transferred toner powder images to sheet 38. One type of suitable fuser is described in U.S. Pat. No. Re. 28,802 issued to Draugelis et al. in 1976. After the fixing process, sheet 38 is advanced by endless belt conveyors 64 and 66 to catch tray 68 for subsequent removal from the printing machine by the operator.

Frequently, after the transfer process, residual toner particles remain adhering to photoconductive surface 12. The final processing station, in the direction of rotation of drum 10 as shown by arrow 14, is cleaning station F. Cleaning station F removes these residual toner particles from photoconductive surface 12. Cleaning station F includes a pre-clean corona generating device (not shown) which neutralizes the charge on photoconductive surface 12 and that of the residual toner particles. This enables fibrous brush 70, in contact with photoconductive surface 12, to remove the residual toner particles therefrom. A suitable brush cleaning system is described in U.S. Pat. No. 3,590,412 issued to Gerbasi in 1971.

It is believed that the foregoing description is sufficient for purposes of the present application to illustrate the general operation of an electrophotographic printing machine having the features of the present invention incorporated therein.

Figure 2:
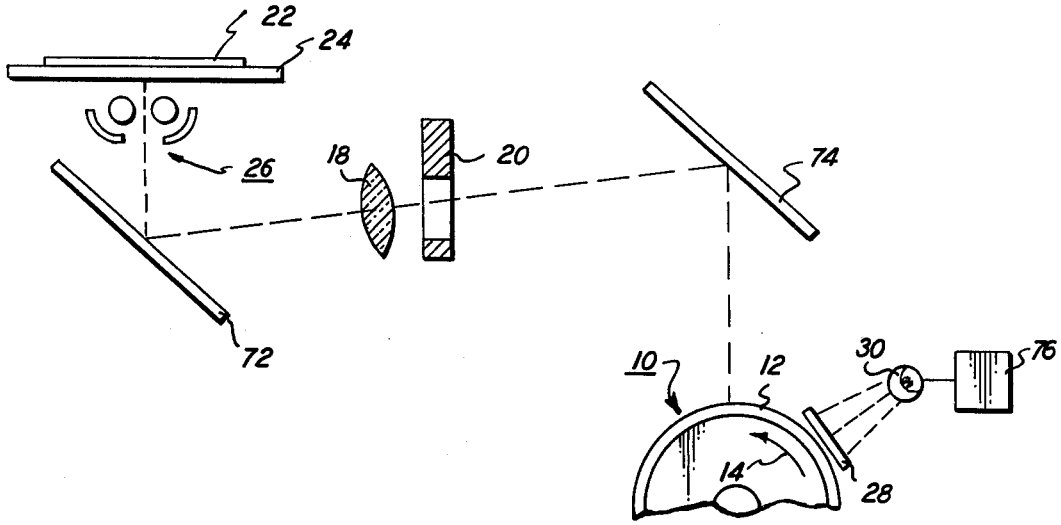
FIG. 2 is a schematic illustration of an optical system employed in the FIG. 1 printing machine.

Referring now to FIG. 2, there is shown the detailed structure of exposing station B. As illustrated therein, lamps 26 move across platen 24 having original document 22 disposed face down thereon. The light rays reflected from original document 22 pass through transparent platen 24 onto mirror 72. Mirror 72 reflects light rays through lens 18 to form a flowing light image thereof. The flowing light image is then transmitted through the appropriate filter of filter mechanism 20 to produce a single color flowing light image. This single color flowing light image is reflected by mirror 74 onto the charged portion of photoconductive surface 12. As shown in FIG. 2, a screen member 28 is positioned at exposure station B prior to the path of the light image. It should be noted that screen member 28 may be located either prior to or subsequent to the light image optical path. The flowing light image irradiates the portion of the photoconductive surface 12 having the screen pattern thereon. In the event that the screen 28 is located after the formation of the flowing light image, the screen light pattern will be projected, in superimposed registration, onto the latent image of the original document recorded on photoconductive surface 12. The screen pattern is formed by screen member 28 having light rays from light source or lamp 30 passing therethrough and irradiating photoconductive surface 12 prior to or subsequent to the formation of the latent image of the original document. High voltage power supply 76 energizes light source 30. Preferably, screen member 28 is a transparent sheet having a plurality of ruled lines or grooves inscribed therein. Voltage source 76 is controlled to actuate lamp 30 at a preselected angular orientation of drum 10. In this manner, a discrete screen pattern is projected onto the charged portion of photoconductive surface 12. The screen pattern moves in the direction of arrow 14 and the flowing light image of the original document is projected thereon in superimposed registration therewith. Hence, a half-tone or modulated electrostatic latent image is thereby recorded on photoconductive surface 12.

Figure 3:
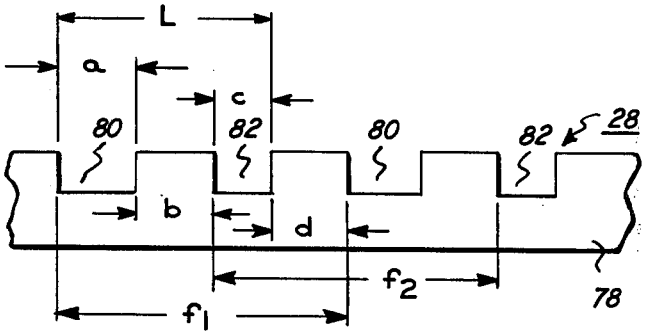
FIG. 3 is an elevational view of a screen employed in the FIG. 2 optical system.

Referring now to FIG. 3, there is shown an elevational view of screen 28. As depicted thereat, screen 28 includes a substantially clear transparent member or substrate 78 having a plurality of spaced grooves inscribed therein. A first set of grooves 80 having a width "*a*" is inscribed in substrate 78. A second set of grooves 82 having a width "*c*" is also inscribed in substrate 78. Each groove 82 of the second set is interposed between two adjacent grooves 80 of the first set. In this manner, a repetitive pattern is formed wherein the grooves of the first set alternate with the grooves of the second set. Grooves 80 and 82 are substantially parallel to one another and extend substantially normal to the longitudinal axis of screen 28. Width "*a*" of groove 80 is greater than width "*c*" of grooves 82. Preferably, width "*a*" is 30% of the distance "L" between successive grooves 80. Contrawise, width "*c*" is 20% of the distance "L" between successive adjacent grooves 80. The phase shift between successive adjacent grooves 80 is preferably about 180°. Similarly, the phase shift between successive grooves 82 is also about 180°. The frequency $f_1$ between successive adjacent grooves 80 and the frequency $f_2$ between successive adjacent grooves 82 is substantially the same. The space "*b*" between adjacent grooves 80 and 82 is about 30% of the distance "L" between successive adjacent grooves 80 in one embodiment thereof. In the corresponding embodiment, the distance "*d*" between grooves 80 and 82 is about 20% of the distance "L" between adjacent grooves 80. In an alternate embodiment, the distance "*b*" is 25% of the distance "L" between adjacent grooves 80, while the distance "*d*" is also 25% of the distance "L" between adjacent grooves 80. Thus, in one embodiment, the spacing between adjacent grooves 80 and 82 is equal. This type of screen structure optimizes copy quality.

Preferably, transparent substrate 78 is made from a suitable glass with grooves 80 and 82 inscribed therein. By way of example, screen member 28 may comprise about 120 grooves per inch. The number of grooves 80 of the first set are substantially equal to the number of grooves 82 of the second set.

Grooves 80 and 82 may be initially inscribed on transparent substrate 78 and then filled with an opaque substance. Alternatively, these grooves may be produced photographically or chemically etched in a thin metal.

In recapitulation, the electrophotographic printing machine employs a sequential screening system wherein an improved screen member is utilized. This screen member includes a first set of grooves wherein each groove has a width thereof greater than the width of each groove of a second set. The spacing between adjacent grooves in one embodiment is equal while the spacing between adjacent grooves in an alternate embodiment is unequal. This screen structure substantially optimizes copy quality.

Thus, it is apparent that there has been provided, in accordance with the present invention, an improved screen for use in electrophotographic printing that satisfies the objects, aims and advantages hereinbefore set forth. While this invention has been disclosed in conjunction with specific embodiments thereof, it is evident that many alternatives, modifications and variations will be apparent to those skilled in the art in light of the foregoing description. Accordingly, it is intended to embrace all such alternatives, modifications and variations that fall within the spirit and broad scope of the appended claims.

What is claimed is:

1. A half-tone screen, including:

a substantially transparent member; and a plurality of grooves formed in said transparent member, said plurality of grooves comprising a first set of grooves and a second set of grooves with the width of each groove of the first set being greater than the width of each groove of the second set and said plurality of grooves being arranged in a repetitive pattern with each groove of the first set being interposed between adjacent grooves of the second set.

2. A screen as recited in claim 1, further including an opaque material disposed in each of said plurality of grooves.

3. A screen as recited in claim 2, wherein said plurality of grooves are substantially parallel to and spaced from one another.

4. A screen as recited in claim 3, wherein each groove of the first set of grooves is of a width comprising about 30% of the distance separating adjacent grooves of the first set.

5. A screen as recited in claim 4, wherein each groove of the second set of grooves is of a width comprising about 20% of the distance separating adjacent grooves of the first set.

6. A screen as recited in claim 5, wherein the distance between a groove of the first set and an adjacent groove of the second set is about 25% of the distance separating adjacent grooves of the first set.

7. A screen as recited in claim 5, wherein the distance between a groove of the first set and a groove of the second set adjacent thereto is about 20% of the distance separating adjacent grooves of the first set.

8. A screen as recited in claim 5, wherein each groove of the first set is phase shifted from one another about 180°.

9. A screen as recited in claim 8, wherein each groove of the second set is phase shifted from one another about 180°.

10. An electrophotographic printing machine for reproducing an original document, including:

a photoconductive member;

means for charging at least a portion of said photoconductive member to a substantially uniform level;

means for exposing the charged portion of said photoconductive member to a light image of the original document recording thereon an electrostatic latent image corresponding thereto;

a screen comprising a substantially transparent member, and a plurality of grooves formed in said transparent member, the plurality of grooves comprising a first set of grooves and a second set of grooves with the width of each groove of the first set being greater than the width of each groove of the second set and the plurality of grooves being arranged in a repetitive pattern with each groove from the first set being interposed between adjacent grooves of the second set, and a light source transmitting light rays through said screen to record a screen pattern on the charged portion of said photoconductive member with the screen pattern and electrostatic latent image being in superimposed registration with one another.

11. A printing machine as recited in claim 10, wherein said screen further includes an opaque material disposed in each of the plurality of grooves.

12. A printing machine as recited in claim 10, wherein the plurality of grooves of said screen are substantially parallel to and spaced from one another.

13. A printing machine as recited in claim 12, wherein each groove of the first set of grooves of said screen is of a width comprising about 30% of the distance separating adjacent grooves of the first set.

14. A printing machine as recited in claim 13, wherein each groove of the second set of grooves of said screen is of a width comprising about 20% of the distance separating adjacent grooves of the first set.

15. A printing machine as recited in claim 14, wherein the distance between a groove of the first set of said screen and an adjacent groove of the second set of said screen is about 25% of the distance separating adjacent grooves of the first set.

16. A printing machine as recited in claim 14, wherein the distance between a groove of the first set of said screen and an adjacent groove of the second set of said screen is about 20% of the distance separating adjacent grooves of the first set.

17. A printing machine as recited in claim 14, wherein each groove of the first set of grooves of said screen is phase shifted from one another about 180°.

18. A printing machine as recited in claim 17, wherein each groove of the second set of grooves of said screen is phase shifted from one another about 180°.

19. A printing machine as recited in claim 12, wherein said exposing means includes:

a light source illuminating the original document; and a lens positioned to receive the light rays transmitted from the original document to form a light image thereof.

20. A printing machine as recited in claim 19, further including means for filtering the light image to form a single color light image which irradiates the charged portion of said photoconductive member to record thereon a single color electrostatic latent image.

21. A printing machine as recited in claim 20, further including:

means for developing each single color electrostatic latent image modulated by the screen pattern with toner particles complementary in color thereto to form successive toner powder images on said photoconductive member;

means for transferring each toner powder image from said photoconductive member to a sheet of support material in superimposed registration with one another; and means for permanently affixing the multi-layered toner powder image to the sheet of support material to form a color copy of the original document.

22. A printing machine as recited in claim 21, wherein the screen pattern is recorded on said photoconductive member prior to recording thereon the electrostatic latent image.

23. A printing machine as recited in claim 21, wherein the screen pattern is recorded on said photoconductive member subsequent to recording thereon the electrostatic latent image.

* * * * *